US008827877B2

(12) United States Patent
Giannelli et al.

(10) Patent No.: US 8,827,877 B2
(45) Date of Patent: Sep. 9, 2014

(54) EXERCISE APPARATUS

(75) Inventors: Raymond Giannelli, Franklin, MA (US); Stephen Suchanek, Uxbridge, MA (US); Dennis Hilson, Blooming Prairie, MN (US)

(73) Assignee: Cybex International, Inc., Medway, MA (US)

( * ) Notice: Subject to any disclaimer, the term of this patent is extended or adjusted under 35 U.S.C. 154(b) by 244 days.

(21) Appl. No.: 13/416,206

(22) Filed: Mar. 9, 2012

(65) Prior Publication Data

US 2013/0040787 A1 Feb. 14, 2013

Related U.S. Application Data

(60) Provisional application No. 61/451,633, filed on Mar. 11, 2011.

(51) Int. Cl.

| | |
|---|---|
| ***A63B 21/062*** | (2006.01) |
| ***A63B 23/12*** | (2006.01) |
| ***A63B 21/04*** | (2006.01) |
| ***A63B 21/00*** | (2006.01) |

(52) U.S. Cl.

CPC ..... *A63B 21/062* (2013.01); *A63B 21/04* (2013.01); *A63B 21/151* (2013.01); *A63B 23/12* (2013.01); *A63B 21/156* (2013.01); *A63B 2021/0623* (2013.01); *A63B 21/00072* (2013.01); *A63B 21/1469* (2013.01); *A63B 21/1484* (2013.01)

USPC ..... 482/102; 482/99

(58) Field of Classification Search

USPC ..... 482/94–103

See application file for complete search history.

(56) References Cited

U.S. PATENT DOCUMENTS

| | | | | |
|---|---|---|---|---|
| 8,172,733 | B1 * | 5/2012 | Batca | 482/99 |
| 8,465,400 | B1 * | 6/2013 | Batca | 482/99 |
| 8,512,212 | B2 * | 8/2013 | Ish, III | 482/100 |

* cited by examiner

*Primary Examiner* — Stephen Crow

(74) *Attorney, Agent, or Firm* — Novak Druce Connolly Bove + Quigg LLP

(57) ABSTRACT

An apparatus for performing an exercise against a resistance mechanism comprised of one or more incremental resistance members, the apparatus comprising:

a frame;

a handle mounted to the frame and interconnected to the resistance mechanism via a cable;

a traveler having a selected resistance force;

a stop mechanism adjustably positionable on the rail at one or more selectable stop positions;

wherein the cable is selectively interconnectable to one or more of the resistance members.

16 Claims, 11 Drawing Sheets

EXERCISE APPARATUS

BACKGROUND OF THE INVENTION

Weightlifting or force resistance equipment is typically configured to allow the user to pull or push on one or more handles that are interconnected to a weight or other force resistance. When the user engages the handles with the user's hands or feet or other part of the user's body, the user's body must typically be oriented or arranged in a predetermined position, orientation or poise to enable the user and the user's limbs to be able to perform the exercise.

SUMMARY OF THE INVENTION

The present invention relates to a weight or force resistance exercise apparatus having handles interconnected to the weight or force resistance that enables the user to select an amount of weight or force resistance to be applied to the exercise and also to select the precise position beyond the normal rest position of the handles at which position or distance the desired amount of weight or force resistance for the exercise cycle is applied to the handle or handles.

In accordance with the invention there is provided an apparatus for performing a pulling, pressing, lifting or squatting exercise by pulling, pressing, lifting or squatting against a resistance mechanism comprised of one or more incremental resistance members each having a selected amount of resistance force, the apparatus comprising:

a frame;

a handle mounted to the frame and interconnected to the resistance mechanism via a cable wound around a handle pulley that is mounted to the frame at a selected position accessible to pulling, pressing, lifting or squatting engagement by the user;

a traveler having a selected resistance force, the traveler being movably mounted on a rail at a stationary start position, the traveler being adapted to engage the cable under a pulling, pressing, lifting or squatting force exerted by a user on the handle, the traveler being pulled in a forward direction along the rail starting from the stationary stop position against the selected resistance force under the pulling, pressing, lifting or squatting force exerted by the user through the cable;

a stop mechanism adjustably positionable on the rail at one or more selectable stop positions each stop position spaced a predetermined distance along the rail away from the stationary start position of the traveler, the stop mechanism being adapted to prevent the traveler from travelling forwardly past a stop position selected by the user;

wherein the cable is selectively interconnectable first to a first one of the resistance members and is further selectively interconnectable to one or more additional ones of the one or more resistance members;

the selected resistance force of the traveler being less than the resistance force of the first one of the resistance members such that the pulling, pressing, lifting or squatting force exerted by the user on the handle acts first to pull the traveler along the rail to the selected position of the stop mechanism and secondly to move one or more of the multiplicity of resistance members after the traveler has been pulled along the rail to the selected position of the stop mechanism.

The cable mechanism typically first pulls the traveler through the selected distance along the rail on pulling, pressing, lifting or squatting of the handle by the user, the cable mechanism subsequently pulling, pressing, lifting or squatting the one or more selected resistance members on engagement of the traveler with the stop mechanism under further pulling, pressing, lifting or squatting force exerted by the user on the handle.

The length of the cable, the stationary start position of the traveler, the interconnection of the cable to the resistance mechanism and the handle are arranged and selected such that the handle is held in a stable position in close adjacency to the handle pulley when the user is not pulling, pressing, lifting or squatting on the handle.

The rail has a selected outside contour and the traveler comprises a hollow tube having a complementary interior contour, the hollow tube slidably receiving the outside surface of the rail such that the traveler is slidably movable along the rail.

The outside contour of the rail and the inner contour of the hollow tube are preferably selected to prevent the traveler from rotating around the rail.

The traveler typically includes a pulley receiving the cable, the cable first pulling the traveler to move forwardly along the rail to the selected position of the stop mechanism under the pulling, pressing, lifting or squatting force exerted by the user and secondly pulling, pressing, lifting or squatting and moving one or more of the multiplicity of selected interconnected resistance members when the traveler is prevented from travelling forwardly along the rail by the stop mechanism.

The length of the cable is preferably selected such that the handle is held in a stable position in close adjacency to the handle pulley when the user is not pulling, pressing, lifting or squatting on the handle, the handle being selectively positionable at a start of exercise position in space that is spaced a distance away from the handle pulley that is substantially equal to the predetermined distance between the selected stop position and the start position of the traveler.

The traveler and the resistance members are interconnected to the cable such that a pulling, pressing, lifting or squatting force exerted on the handle that is greater than or equal to the resistance force of the traveler acts first to move the traveler along the rail to the selected stop position and secondly to move one or more of the resistance members when the user exerts a pulling, pressing, lifting or squatting force that is greater than the sum of the resistance force of the traveler and the selected amount of the resistance force of the one or more resistance members.

The traveler typically has a first selected weight, the traveler being slidably mounted and arranged on the rail such that a pulling, pressing, lifting or squatting force exerted on the handle that is greater than or equal to the first selected weight acts to move the traveler upwardly in opposition to gravity along the rail to the selected stop position.

The one or more resistance members each preferably have an incremental weight, the resistance members each being mounted and arranged on the frame such that a pulling, pressing, lifting or squatting force exerted on the handle that is greater than the sum of the first selected weight and the incremental weight of the one or more selected resistance members pulls the one or more selected resistance members upward in opposition to gravity.

The apparatus preferably further comprises a second handle mounted to the frame and interconnected to the resistance mechanism via a cable wound around a second handle pulley that is mounted to the frame at a selected position accessible to pulling, pressing, lifting or squatting engagement by the user.

The length of the cable, the stationary start position of the traveler, the interconnection of the cable to the resistance mechanism and the second handle are arranged and selected such that the second handle is held in a stable position in close adjacency to the second handle pulley when the user is not pulling, pressing, lifting or squatting on the second handle.

Preferably the frame is typically disposed on a floor or ground surface and the apparatus preferably further comprises:

a first pad comprising a triangular prism having a pair of rectangular surfaces disposed at a first selected angle relative to each other, one of the rectangular surfaces of the first pad being disposed on or above a portion of the floor or ground surface that is adjacent the position of the frame on the floor or ground surface such that the user can stand, sit or kneel on top of or above the other rectangular surface of the pad with either one of a left or right foot and readily access the handle with a selected body part of the user, the first selected angle being at least about 3 degrees.

In such an embodiment the apparatus preferably further comprises:

a second pad comprising a triangular prism having a pair of rectangular surfaces disposed at a second selected angle relative to each other, one of the rectangular surfaces of the second pad being disposed on or above a portion of the floor or ground surface that is immediately adjacent the first pad such that the user can stand, sit or kneel on top of or above the other rectangular surface of the second pad with the other of the left or right foot and readily access the handle with a selected body part of the user, the second selected angle being at least about 3 degrees.

Further in accordance with the invention there is provided, a method of performing a force resistance exercise on a machine comprising:

a frame and a handle mounted to the frame and interconnected to the resistance mechanism via a cable wound around a handle pulley that is mounted to the frame at a selected position accessible to pulling, pressing, lifting or squatting engagement by the user;

a traveler having a selected resistance force, the traveler being movably mounted on a rail at a stationary start position, the traveler being adapted to engage the cable under a pulling, pressing, lifting or squatting force exerted by a user on the handle, a stop mechanism adjustably positionable on the rail at one or more selectable stop positions each stop position spaced a predetermined distance along the rail away from the stationary start position of the traveler, the stop mechanism being adapted to prevent the traveler from travelling forwardly past a stop position selected by the user;

wherein the cable is selectively interconnectable first to a first one of the resistance members and is further selectively interconnectable to one or more additional ones of the one or more resistance members;

the selected resistance force of the traveler being less than the resistance force of the first one of the resistance members such that the pulling, pressing, lifting or squatting force exerted by the user on the handle acts first to pull the traveler along the rail to the selected position of the stop mechanism and secondly to move one or more of the multiplicity of resistance members after the traveler has been pulled along the rail to the selected position of the stop mechanism;

the method comprising:

selecting a stop position for the stop member along the rail;

selecting one or more of the resistance members and interconnecting the selected one or more resistance members to the cable;

exerting a pulling, pressing, lifting or squatting force on the handle that is greater than the selected resistance force of the traveler to pull the traveler along the rail to the stop position;

exerting a pulling, pressing, lifting or squatting force on the handle that is greater than the sum of the selected resistance force of the traveler and the resistance force of the one or more selected resistance members.

In another aspect of the invention there is provided an exercise apparatus, comprising:

a frame;

a weight stack mounted on the frame;

a cable configured to engage the weight stack through a plurality of pulleys, the cable including two terminal ends, each terminal end having a handle;

a selector movably mounted on a rail, the selector including a stop mechanism configured to prevent a slider from moving beyond a position along the rail; and a slider mounted below the selector on the rail by means of one of the plurality of pulleys such that the slider moves freely along the rail responsive to the tension in the cable, the slider is configured to engage the stop mechanism and provide at least one of slack and tension in the cable based on a position of the selector and the stop mechanism on the rail, wherein before the slider engages the stop mechanism, the cable does not engage the weight stack, and after the slider engages the stop mechanism, the cable engages the weight stack.

DETAILED DESCRIPTION OF THE INVENTION

Figure 1:
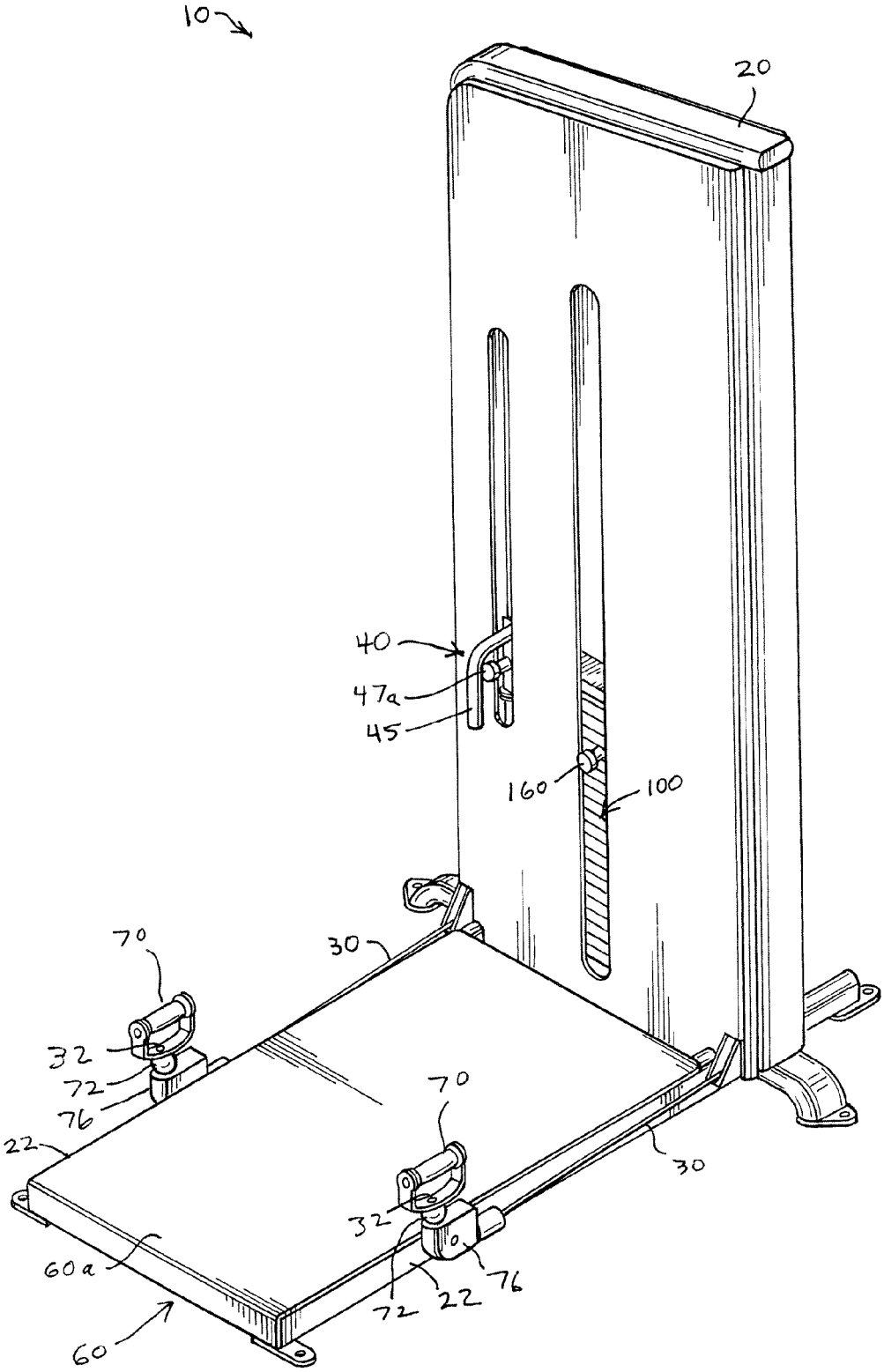
FIG. 1 shows a front right perspective view of an apparatus assembled together with cover plates on the frame according to the invention.
Figure 2:
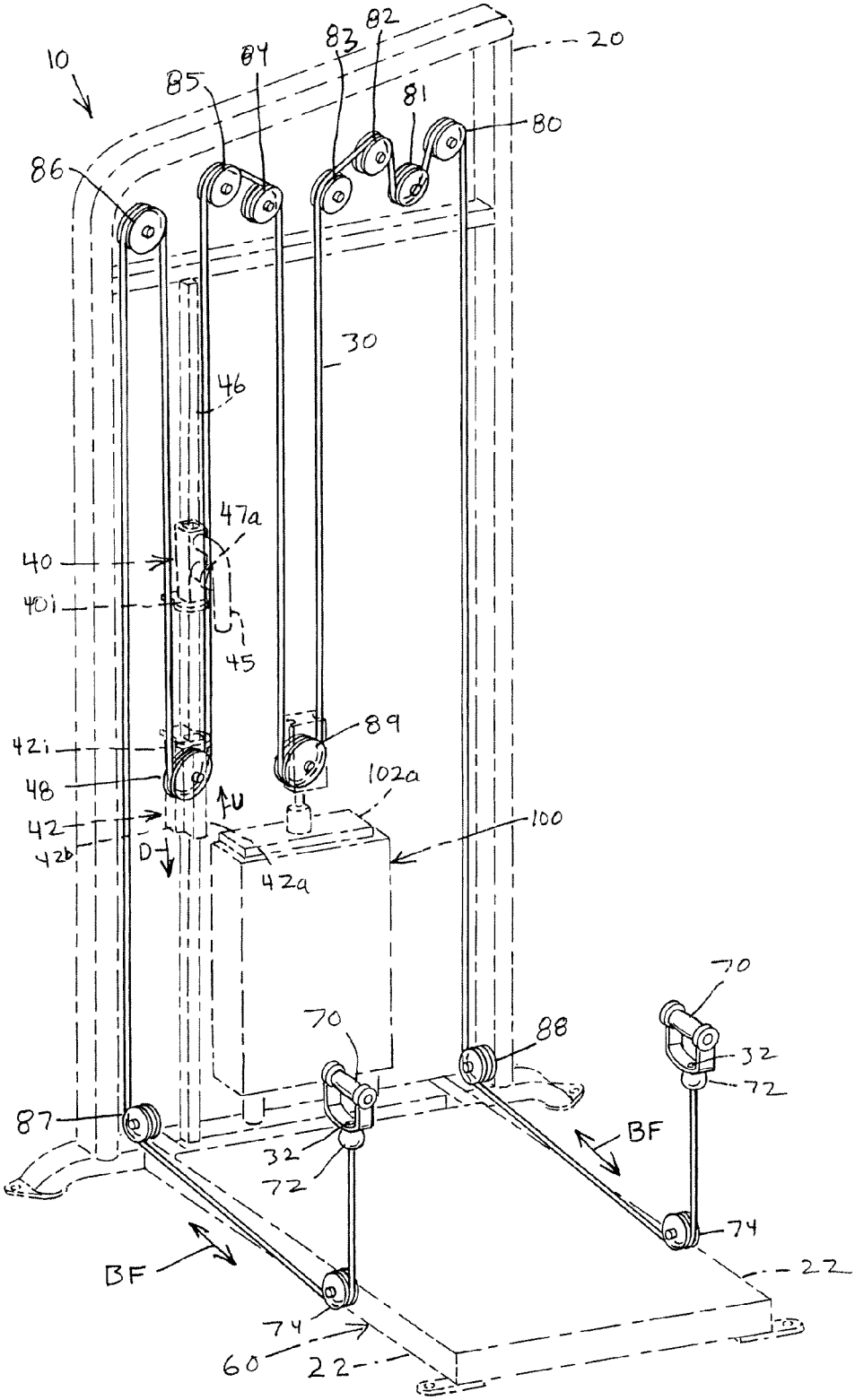
FIG. 2 shows a side perspective exploded view of the apparatus in FIG. 1.

FIGS. 1-3A show an exercise machine 10 according to the invention comprising a frame 20, platform 60, cable 30 and start exercise position selector 40, 50. The handles 70 are connected to the terminal ends 32 of the cable 30. The handles are provided with stops 72 that prevent the handles from being pulled past the mounting positions of the handle pulleys 74. As shown, the weighted slider is freely slidably mounted on the positioning rail 46 such that the slider 42 is constantly weighing down on the cable 30 through slider pulley 48. Thus the slider 42 acts to constantly pull on the cable 30 under the force of its own inherent weight so that the stops 72 of the handles 70 are constantly engaged under the weight of the weighted slider 42 with the pulleys and mounts 74, 76 for the handles.

The length of the cable 30 and the length of the slider rail 46 are selected together with the relative positioning and mounting of the remaining pulleys 74 and 80-89 to the frame 20 such that the two ends 32 of the cable 30 are seated in a rest position at the locations of pulleys and mounts 74, 76 with the cable 30 being maintained taut and under tension by the slider 42, the handle stops 72 being constantly pulled into engagement with the handle pulleys 74 under the weight force of the slider 42. The mounting brackets 76 and pulleys for the handles 70 are typically mounted on the side edges 22, FIGS. 1-3A of the platform 60 in a predetermined location that is convenient for a user to manually engage and pull on the handles 70. The pulleys 74 are mounted to the side rails 22 via mounting that allow the pulleys 74 to freely rotate under force of friction engagement with the cable 30 when the cable 30 is moved in a back or forth BF direction, FIG. 2, the cable 30 being frictionally engaged and received within the receiving grooves of pulleys 74.

As can be readily imagined the handle mounts 76 can be mounted in any desired location relative to the frame 20 or platform, the location of the handles being selected to enable a user ready access to begin an exercise cycle. The handle mounts 76 are mounted on a structural mounting member such as side rails 22 that is interconnected to the frame 20 to which the weight stack 100 is mounted.

Figure 3A:
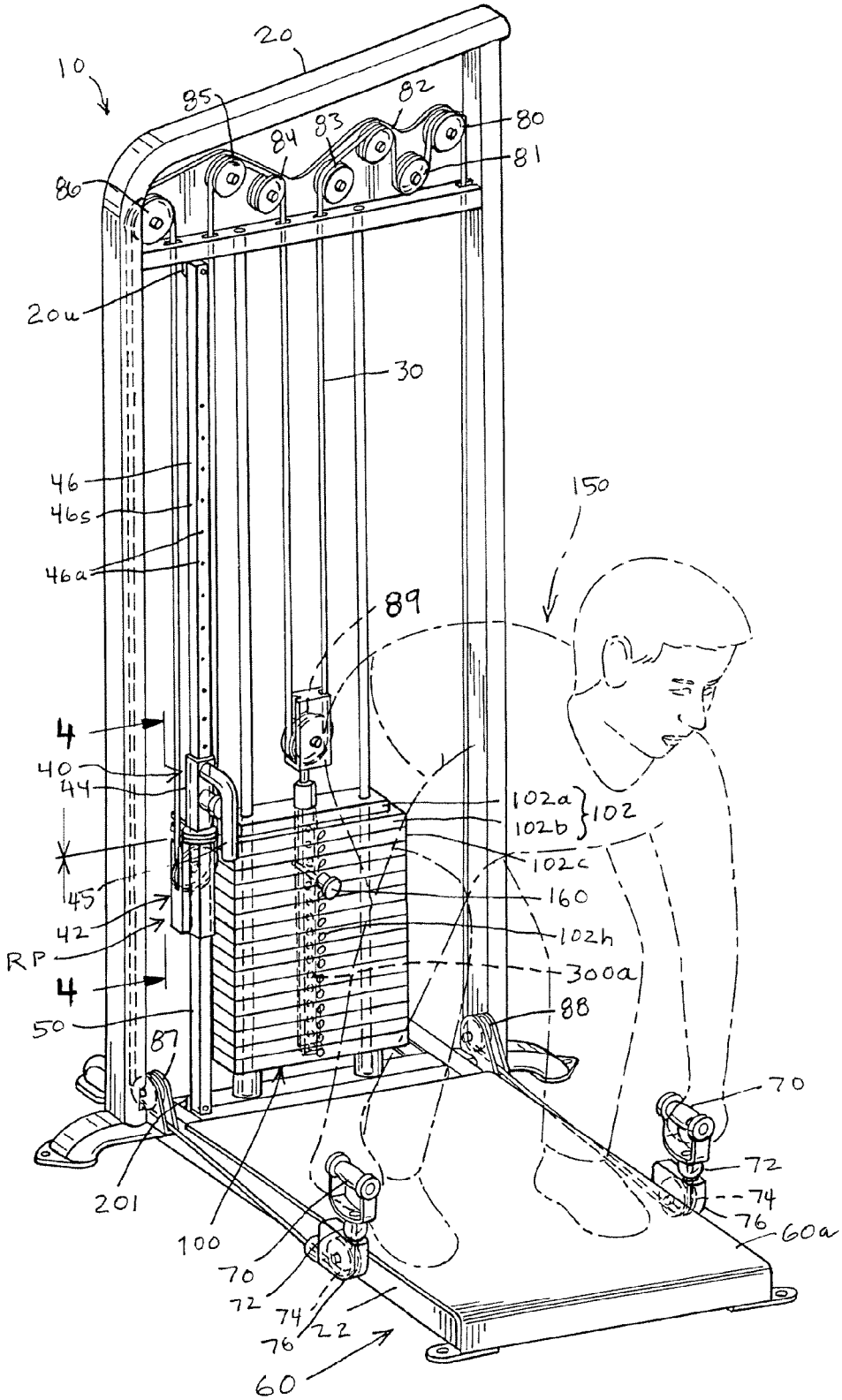
FIGS. 3A, 3B show a user in first and second sequential exercise positions pulling, pressing, lifting or squatting on the handles of the FIG. 2 machine when the stop mechanism is fixed on the positioning rail in the exercise start position
Figure 3B:
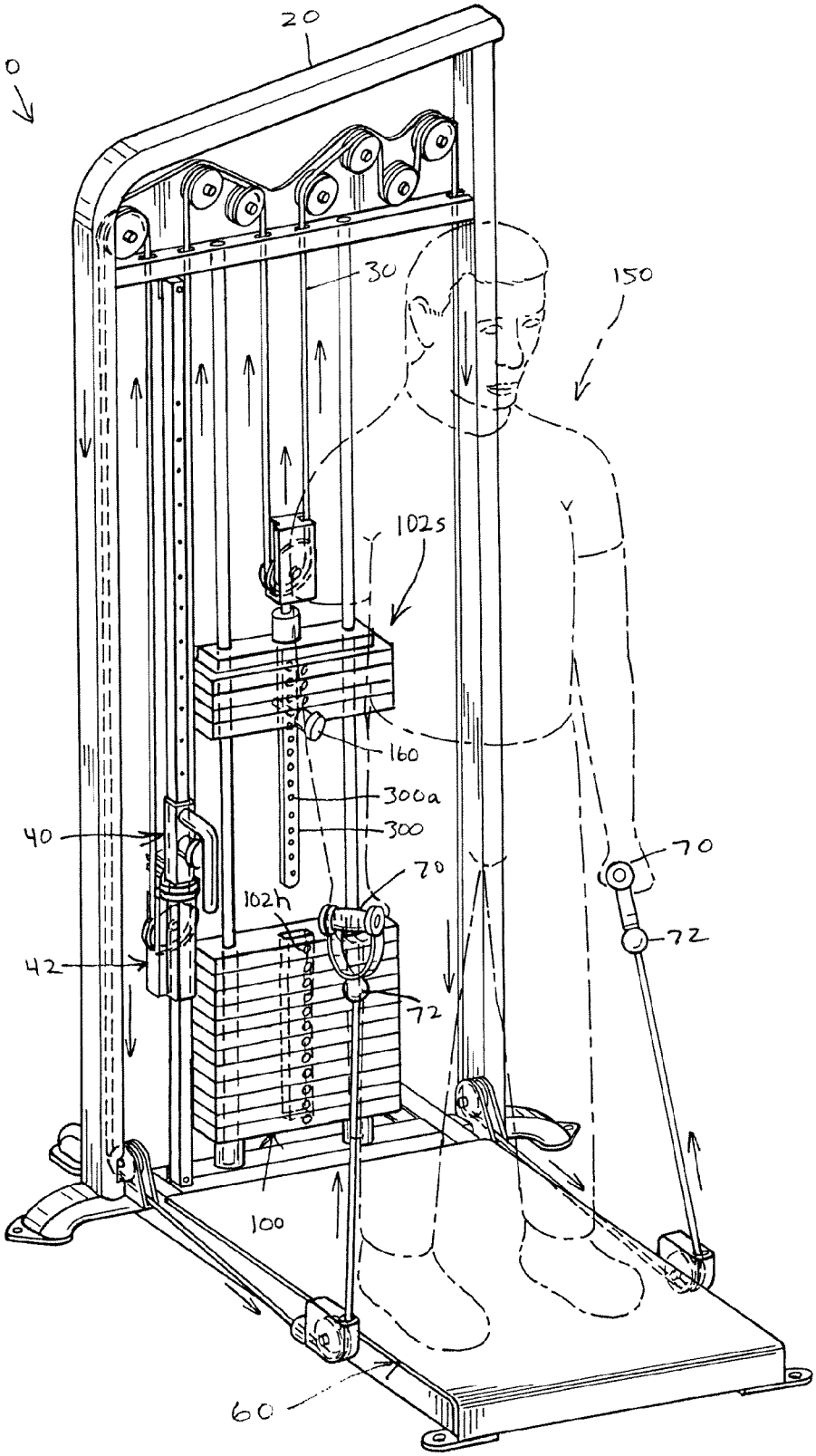
Figure 4:
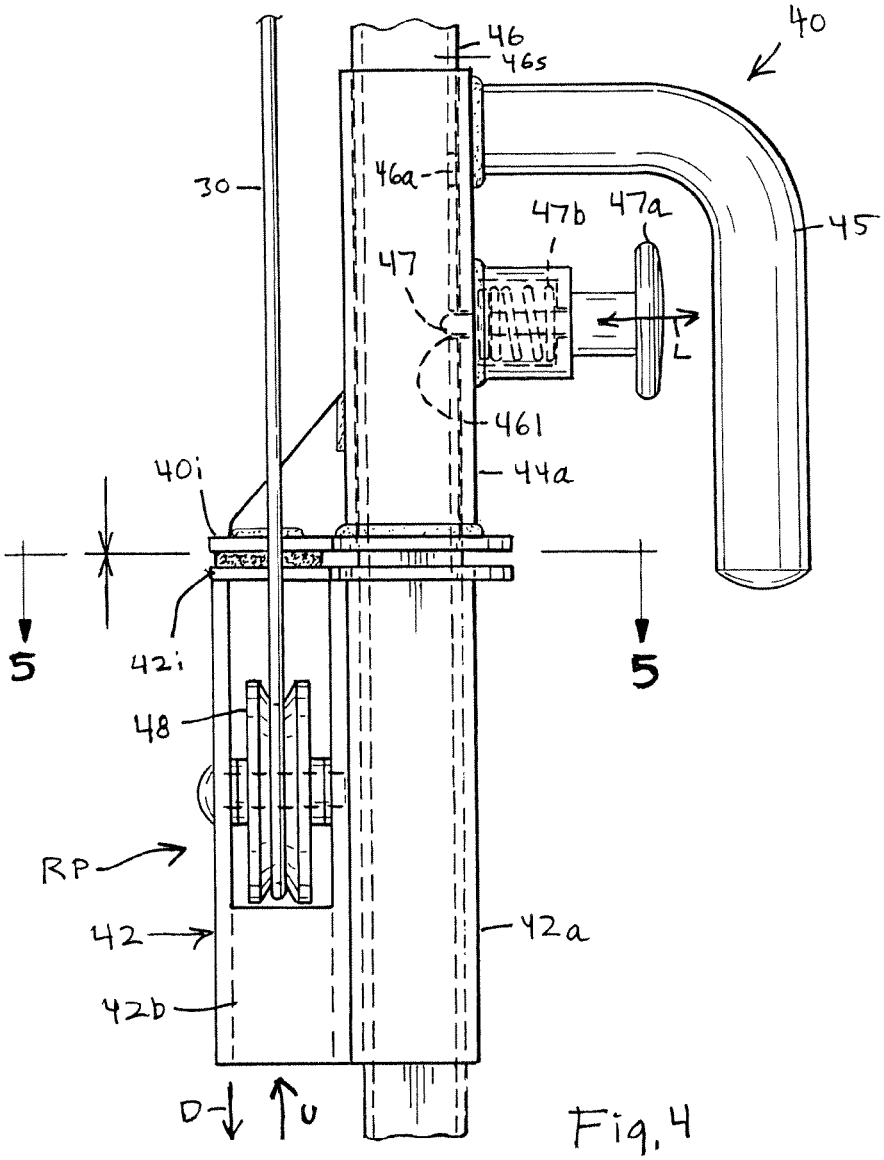
FIG. 4 shows a closeup left front perspective view of the weight stack and rail, slider and stop components of the FIG. 2 apparatus with the stop component fixed on the rail in an exercise start position where the cable engages the weight stack immediately when the user starts to pull on the handles in their rest position.
Figure 5:
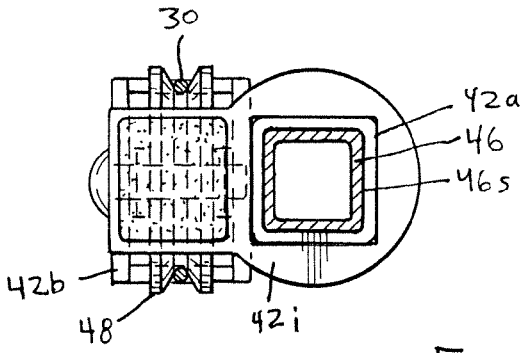
FIG. 5 shows a closeup view of the positioning rail according to aspects of the invention.

As shown in FIGS. 3-5, the positioning rail 46 is rigidly connected to the frame 20 at upper 20*u* and lower 20*l* frame connectors and is disposed in an upright position from bottom to top. A stop mechanism 44 shown in the exemplary embodiment of FIGS. 3A-6E is configured having a square or rectangular (in cross-section) tube 44*a* that is complementary in size and configuration (in cross-section) to the exterior cross-sectional size and configuration 46*s* of rectangular or square positioning rail 46. As shown, the tubular component 44*a* of slider 42 is slidably received around outside surface 46*s* of rail 46 such that the stop mechanism 44 can be manually slid along the top to bottom length of rail 46 by means of handle 45 to any desired or selected top to bottom position in alignment with any selectable one of pin receiving apertures 46*a*. The stop mechanism 44 is provided with a spring-loaded laterally sliding pin 47 that can be engaged with any one of the series of top-to-bottom arranged receiving apertures 46*a*. The spring loaded pin 47 is readily manually slidable back and forth in a lateral direction L from the tubular component 44*a* such that the pin 47 can be engaged within or disengaged from any selected aperture 46*a* with which the pin 47 may be laterally aligned by hand by the user. Thus when the user manually releases the head 47*a* of the pin 47, a spring 47*b* acts to move the pin laterally L toward, into and through one of the apertures 46*a* thus firmly holding the stop mechanism 44 in a selected vertical location coincident with the vertical position of the selected aperture 46*a* along the vertical length of the rail 46. As shown the apertures 46*a* are spaced at a selected series of different and selectable vertical positions along vertically disposed rail 46. Alternatively pin 47 can be adapted to releasably engage and remain within an aperture 46*a* with or without a spring load.

As shown particularly in, FIGS. 1-5, a lower end of the stop mechanism 44 is configured to provide an interference mechanism 40*i* that engages with an upper end or other complementary part 42*i* of the body 42*a*, 42*b* of the slider 42. The slider 42 has a square or rectangular (in cross-section) tubular component 42*a* that has an interior cross-sectional size and shape complementary to the exterior of rail 46. The interior of tubular component 42*a* slidably receives rail 46 in the same manner as component 44*a* such that the slider 42 is readily slidable along the vertical length of rail 46 when pulled upwardly by cable 30 or downwardly under the force of its own inherent weight. The slider 42 is typically comprised of metal components 42*a*, 42*b*, 42*i* and 48 collectively having a weight of between about 0.5 pounds and about 5 five pounds, the slider being mounted on the rail 46 such that the slider is freely slidable and thus constantly being urged downwardly D under force of its own weight. The slider 42 has a pulley 48 rotatably mounted on and to its body 42*a*, 42*b* for receiving the cable 30. The cable 30 is routed around slider pulley 48 in a manner such that the weight of the slider 42 is constantly pulling downwardly D on the cable 30 keeping the cable 30 taut.

At the beginning of an exercise cycle, the user selects a vertical aperture or position 46*a* to which the stop mechanism 44 is pinned via pin 47. The length of the cable 30 is selected relative to the positions of mounting of the series of pulleys 48, 74, 80-89 such that the slider 42 has a predetermined lowermost rest or start position RP at a selected location along the vertical length of rail 46, the lowermost vertical rest or start position being shown in FIGS. 3A, 3B and 6A. The slider 42 is held in this lowermost start or rest position RP by engagement of the handle stops 72 with the handle pulleys 74 and mounting brackets 76 and the preselection of the length of cable 30 and positioning of the various pulleys 48, 74, 80-89.

Figure 6A:
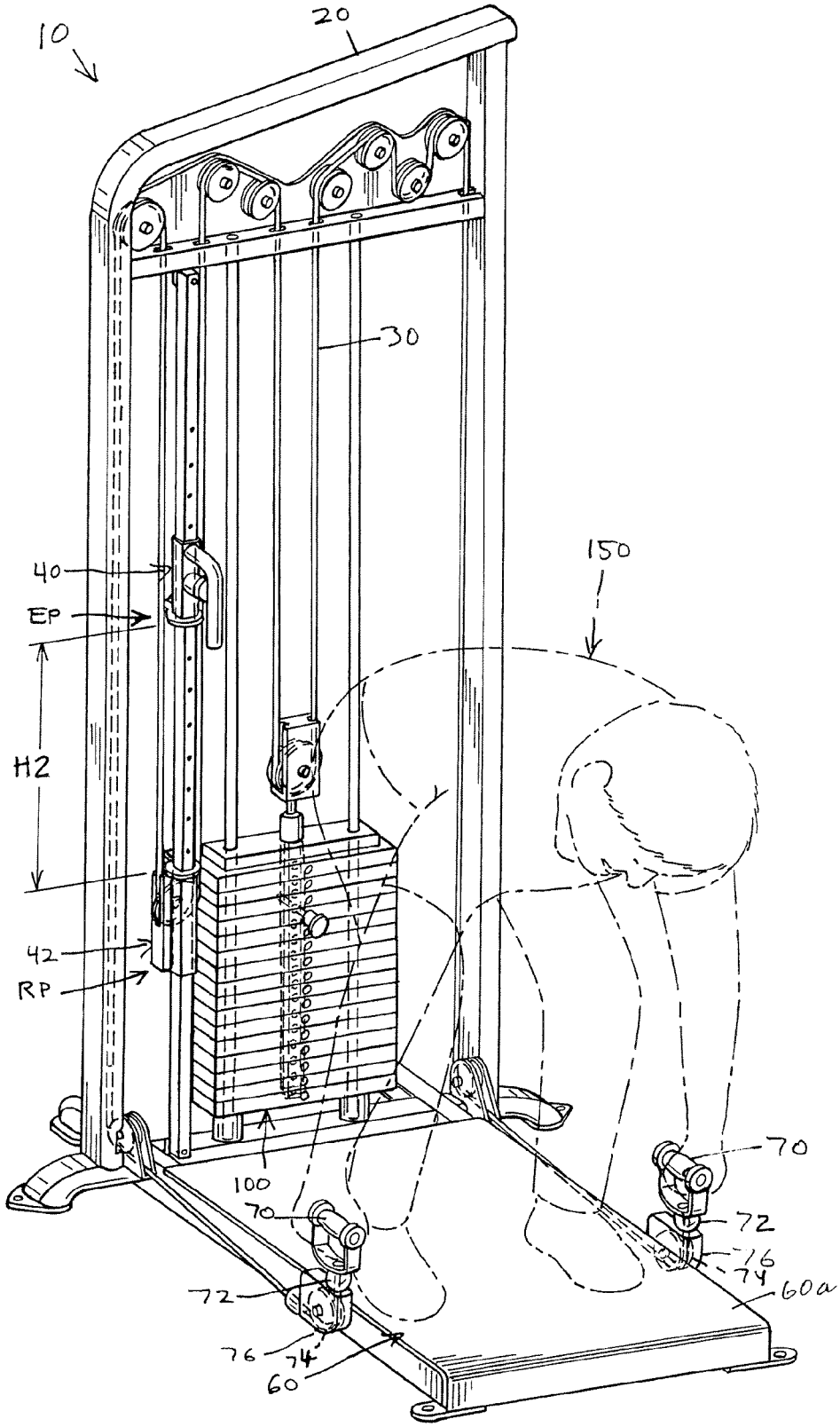
FIGS. 6A-6E show a user in a series of five sequential exercise positions pulling, pressing, lifting or squatting on the handles of the FIG. 2 machine when the stop mechanism is fixed on the positioning rail in a start position where the cable does not pull on the weight stack until the handles have been pulled a selected distance away from their rest position.
Figure 6B:
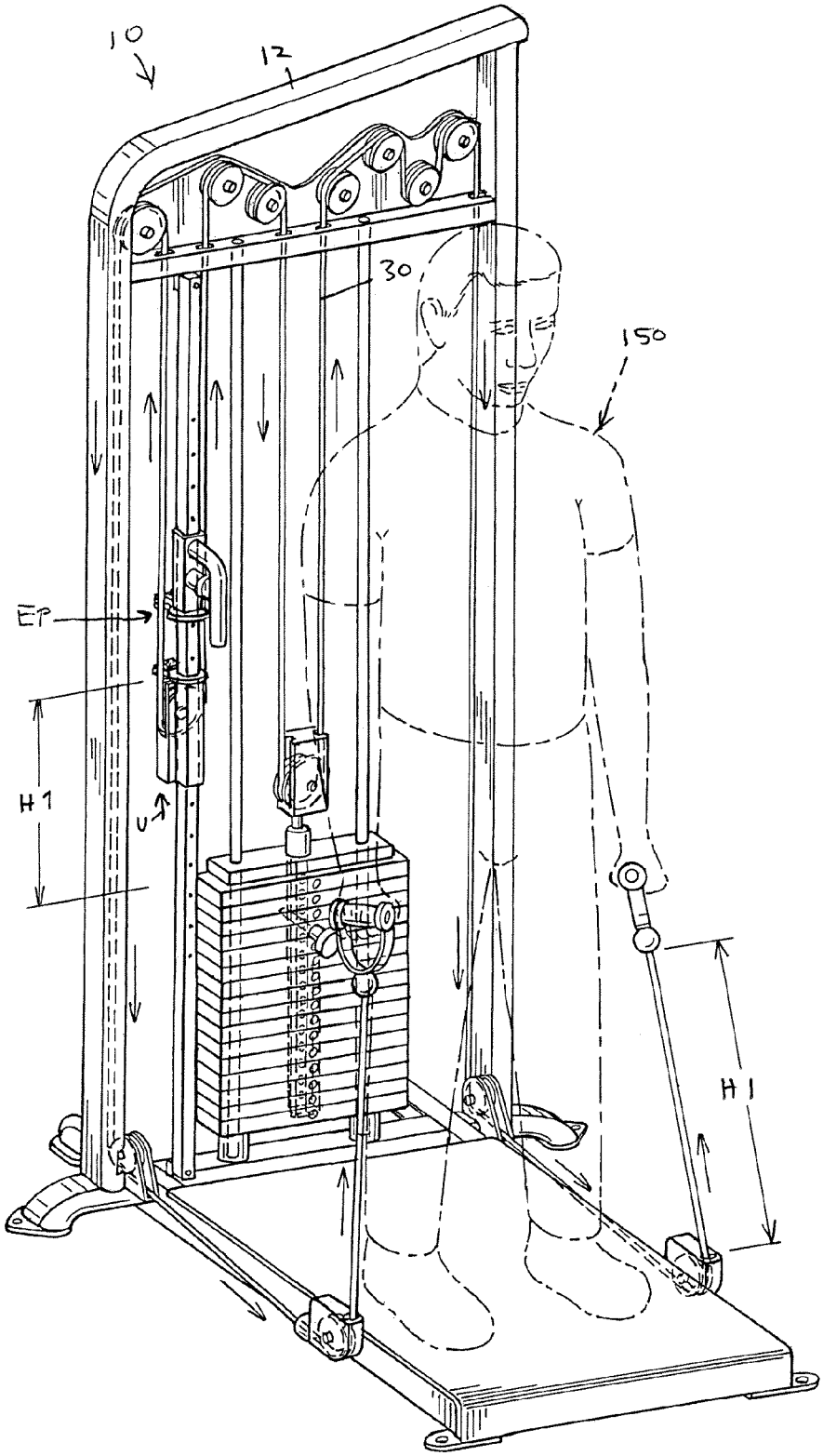
Figure 6C:
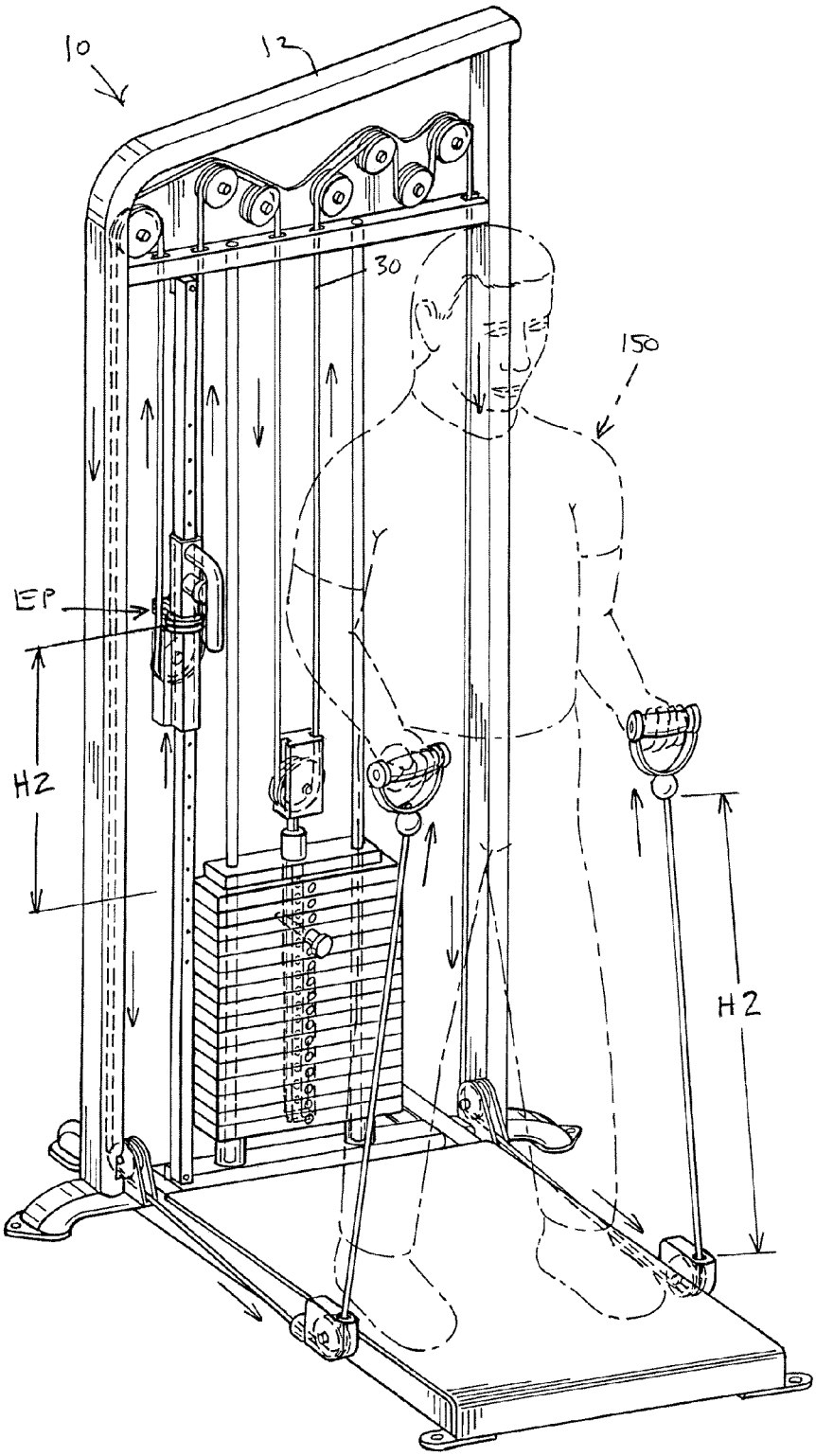
Figure 6D:
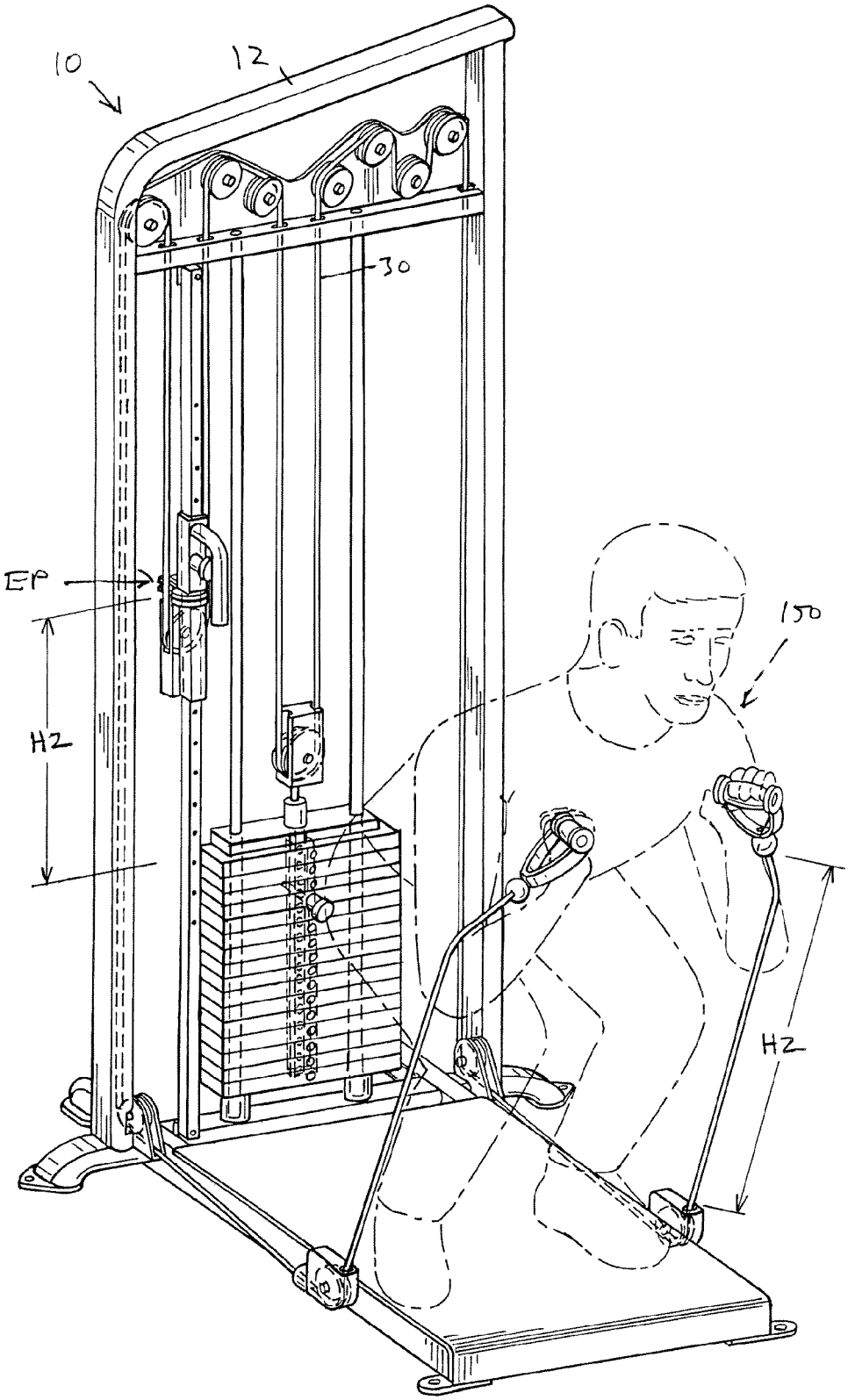
Figure 6E:
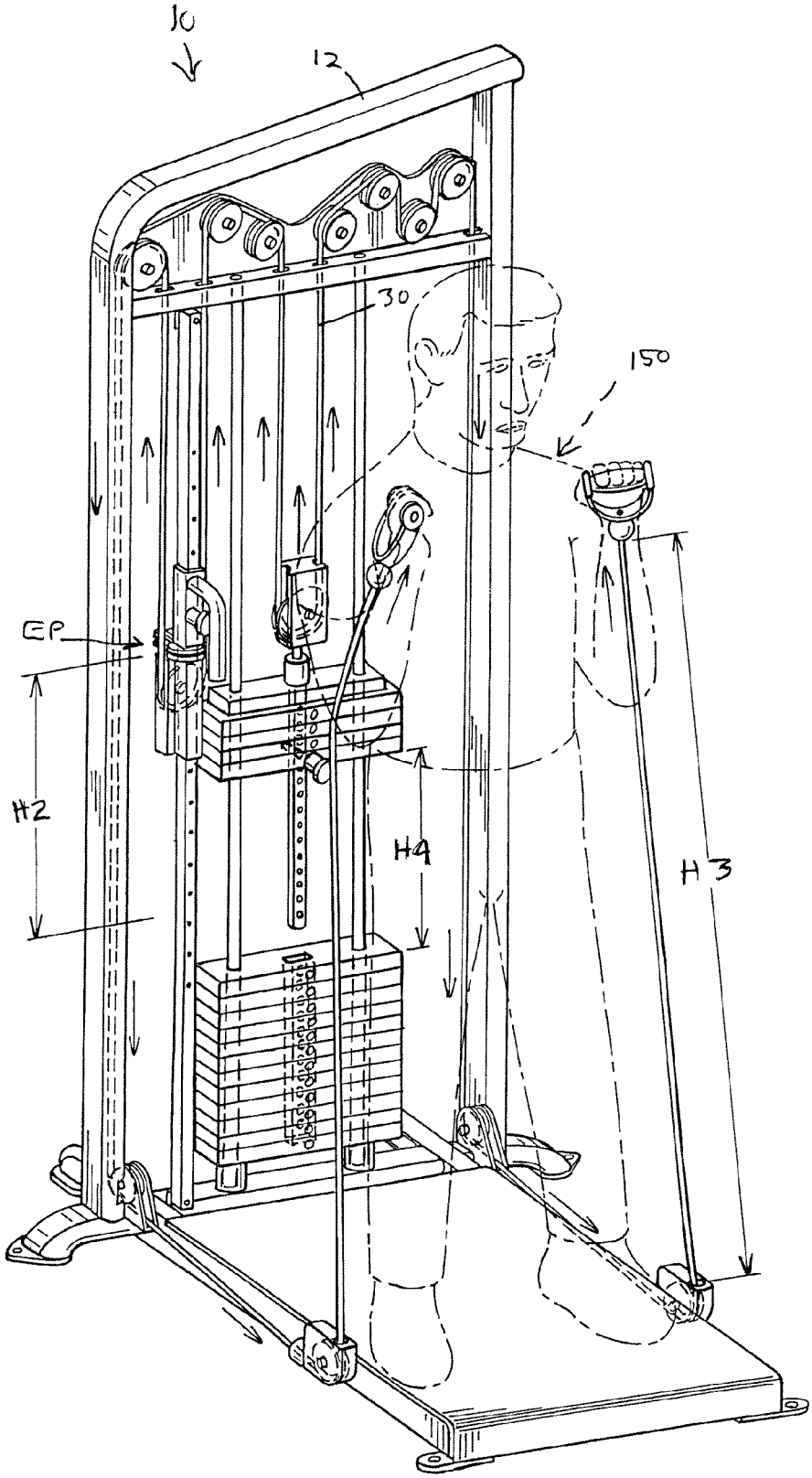

At the beginning of an exercise cycle with the slider 42 in the lowermost start position RP, the user 150 starts to pull on the handles 70 as shown in FIGS. 3A, 6A. With the weight of the slider 42 being less than the weight of the lowest amount of weight 102 that is connected to the weight stack pulley 89, when the user engages and pulls on the handles 70, the user first pulls on the weight D of the slider 42 to move the slider 42 upwardly U along the rail until the slider 42 engages the stop mechanism 44. The least amount of connectable weight 102 in the weight stack is typically the combination of an interface weight 102*a* and the first single weight increment or bar 102*b* in the weight stack 100 to which the cable 30 is connectable. As shown in FIGS. 3A, 3B, one or more individual ones 102*b*, 102*c* of a stack of incremental weight members comprise the weight stack 100 that the user can selectively connect to the cable to perform a weight resistance exercise cycle. Any selected one or more of the incremental weights 102*b*, 102*c* are interconnectable to the cable 30 via the connection of the cable 30 to the cable pulley 89 which is in turn connected to the weight stack interface 102*a*. The interface 102*a* is in turn connected to a manifold 300 which in turn is selectively interconnectable to one or more individual weight members 102*b*, 102*c* by inserting pin 160 laterally through an aperture 102*h* of a selected weight member 102*b*, 102*c* and an aligned aperture 300*a* of the manifold 300.

In the exercise cycle shown in FIGS. 3A, 3B the user 150 has selected the start of exercise or start position for pulling on the weight-stack 100 to begin at the lowermost RP position of the slider 42. As shown, the user has affixed the pin 47 of the stop mechanism 44 into the lowermost RP position aperture 461 on the position rail 46, FIGS. 3A, 3B, 4, such that the stop mechanism 44 prevents the slider 42 from travelling upwardly U, FIG. 4, any further than the lowermost RP position of the slider. Thus with the stop mechanism 44 in the lowermost RP position, the user begins immediately when the handles 70 start at the position of the handle pulleys 74 pulling, pressing, lifting or squatting on and against the weight of the selected set 102*s* of individual weights 102*b*, 102*c* from the weight stack 100.

In the exercise shown in FIGS. 6A-6E, the user has, at the beginning of the exercise cycle, positioned the stop mechanism 44 at a selected elevated height position EP that is H2 distance from the RP position, FIG. 6A. As shown, when the user first starts to pull on the handles 70, the user 150 is pulling, pressing, lifting or squatting only against the relatively light amount of weight of the slider 42, first moving the slider 42 upwardly along rail 46 by a distance H1, FIG. 6B, then further by a distance H2, FIG. 6C at which point the slider 42 engages and is stopped by the stop mechanism 44. At this point, the user's pulling, pressing, lifting or squatting force is now being exerted against the weight of both the slider 42 and the amount of the weight of the selected number 102 of stack weights, FIG. 6E. At the point in the exercise cycle shown in FIG. 6E, the user is shown switching to a squat exercise orientation with the handles and slider 42 being held by the user at the selected pull height H2. Next in the cycle, FIG. 6E, on further exertion of pulling, pressing, lifting or squatting force by the user 150, the handles are pulled a distance H3 from their initial rest positions RP, and the selected amount of weight 102*s* of the weight stack is pulled a distance H4 equal to H3-H2 against the combined weight of the slider 42 and the selected amount of weight 102*s*.

Figure 7:
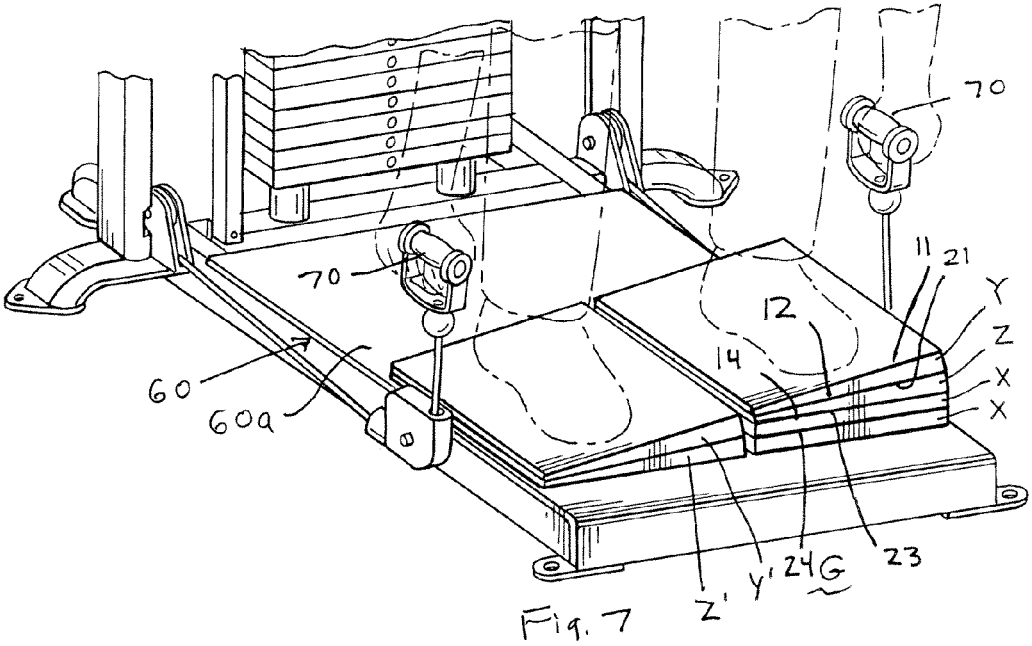
FIG. 7 is a front perspective view of an exercise machine having two sets of pads on which a user can stand, the pads being disposed on the top surface of a platform extending outwardly from the front of the machine and securely disposed on the floor surface immediately in front of the machine.
Figure 8:
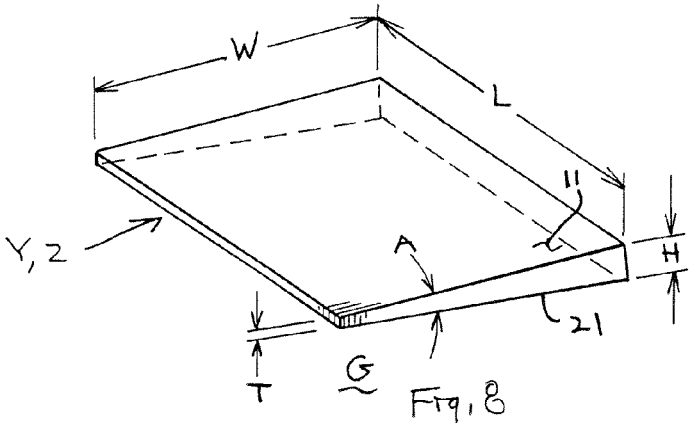
FIGS. 8 and 9 are top perspective views of a wedged triangular prismatic pad and a rectangular prismatic pad as components of an apparatus according to the invention as described herein.
Figure 9:
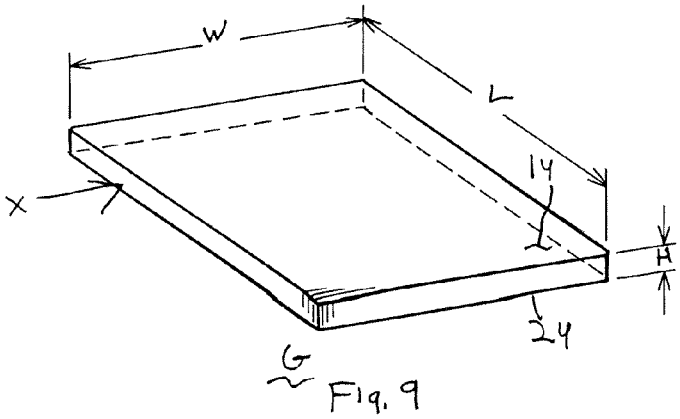

FIGS. 7, 8, and 9 show an embodiment where the user can stand on one or more wedged pads or triangular prisms Y, Z, Y' with one or both feet while performing an exercise cycle. As shown at least one and preferably two wedged triangular prisms, X, Y (or X', Y') are provided for arrangement on the standing surface immediately adjacent the weight stack 100. Each wedged triangular prism Y, Z (or Y', Z') has a pair of rectangular surfaces such as surfaces 11, 21 for prism Y and surfaces 12 for prism Z. The pair of rectangular surfaces of the triangular prisms are disposed at an angle A of between about 3 and about 10 degrees relative to each other.

The triangular prisms Y, Z or Y', Z' are typically arranged one on top of each other and both triangular prisms being disposed on top of a rectangular prism X or X'. Alternatively, one triangular prism Y or Z is disposed on top of a rectangular prism X with the rectangular prism X in turn being disposed on top of the other of the two triangular prisms Y, Z. As shown, the triangular prisms have a lower rectangular surface 21 or 23 that is mated with and disposed on top of an upper rectangular surface 11 or 12 of the other of the prisms. As shown, the prisms Y, Z are disposed on the level surface 60*a* of the platform 60 on which the user stands, sits or kneels while performing the exercise. The pads Y, Z, Y', Z' and X and X' could alternatively be mounted on the level ground surface G. In the embodiment of the apparatus 10 as shown, the platform 60 is preferably connected to the frame 20 of the machine and the top surface 60*a* is generally flat and parallel to the level ground surface. The pads X, X', Y, Y', Z, Z' as shown in FIGS. 7-9 are preferably mounted on surface 60*a*.

The machine thus can further comprise a first pad Y comprising a triangular prism having a pair of rectangular surfaces disposed at a first selected angle relative to each other, one of the rectangular surfaces of the first pad being disposed on or above a portion of the floor or ground surface that is adjacent the frame, the first pad Y or Y' being arranged such that the user can stand, sit or kneel on top of or above the other rectangular surface of the first pad with either one of a left or right foot and readily access the handle 70 with a selected body part of the user, the first selected angle being at least about 3 degrees.

The machine can further include a second pad such as pad Y that comprises a triangular prism itself having a pair of rectangular surfaces disposed at a second selected angle relative to each other, one of the rectangular surfaces of the second pad Z being disposed on the floor or ground surface immediately adjacent the first pad such that the user can stand, sit or kneel on top of the other rectangular surface of the second pad with the other one of the left or right foot and readily access the handle mechanism with the selected body part, the second selected angle being at least about 3 degrees.

FIG. 8 shows a wedged or angled or triangular prism or prismatic pad Y or Z as designated in other Figures herein. The prism Y or Z pad is typically comprised of a solid polymeric material such as rubber having a non-skid or relatively sticky outside surface such that when a user stands or kneels or sits on the surface, the user will not slide along the surface. As shown, the triangular prism Y or Z has two square or rectangular faces or surfaces 11, 21 that are disposed at a selected angle "A" relative to each other such that when one of the rectangular surfaces 11, 21 is laid flat on a level surface such as a floor or ground surface G or on a top surface PS (not shown) of another structure such as a platform P (not shown), the other of the two surfaces 11 or 21 faces upwardly and is disposed at the angle A relative to the level surface G or PS. The angle A is typically selected to be between about 3 and about 10 degrees. The maximum thickness or height H of the pad Y or Z is typically between about 0.75 and about 2 inches. The minimum thickness T is between about 0.25 and about 1.5 inches. The length L and the width W of the triangular pad Y or Z is typically between about 9 and about 15 inches.

FIG. 9 shows a rectangular prism or prismatic pad X having a height H of between about 0.25 and about 1.5 inches. The top 14 and bottom 24 rectangular surfaces are generally parallel to each other. The length L and width W of pad X is typically between about 9 and about 15 inches. The pad X is typically comprised of the same or similar polymeric material as the pads Y, Z. The corners are all right angles.

The pads Y, Z, X are typically solid.

As shown in FIG. 7, two sets of a combination of one or more of pads Y, Z and X and one or more of pads Y', Z' and X' are arranged side-by-side each other on a level surface G or 60*a* that is disposed immediately adjacent the front side of an exercise machine such that the user can stand on the top-most surface of the sets of pads and readily engage and pull on one or more handle mechanisms of the exercise apparatus with a limb of the user such as a hand or foot. Each set of pads includes at least one triangular pad arranged such that the slope of the top surface 11 or 12 or 14 of the combination of pads is disposed at an angle relative to the level surface G or 60*a*

Preferably each set of pads comprises at least two triangular pads arranged one on top of each other where the lower rectangular or square surface 21 of one triangular prism Y or Z (or Y', Z') is mated with and substantially overlaps the upper rectangular or square surface 12 of another triangular prism Y or Z (or Y', Z'). The bottom surface 22 of the lower pad Z (or Z') is arranged on a flat ground surface G or other flat surface 60*a* that overlies the ground surface extending forwardly or laterally immediately adjacent the exercise apparatus such that the user can stand or sit or kneel on the top surface and readily manually engage a handle mechanism on the machine for performing an exercise cycle which is typically a weight pulling or pushing exercise or action. Most preferably each set of pads further comprises a rectangular prism X (or X')

having opposing rectangular surfaces that are about the same size as the surfaces 11, 12, 21, 22.

The apparatus may comprise a single set of pads that comprise a single triangular prism Y or Y' and preferably comprises at least two triangular prisms, Y, Z or Y', Z' and most preferably comprises a rectangular prismatic pad X or X' in addition.

What is claimed is:

1. An apparatus for performing a pulling, pressing, lifting or squatting exercise by pulling, pressing, lifting or squatting against a resistance mechanism comprised of one or more incremental resistance members each having a selected amount of resistance force, the apparatus comprising:

a frame, a cable, a handle pulley, a rail, a handle mounted to the frame and interconnected to the resistance mechanism via the cable wound around the handle pulley that is mounted to the frame at a selected position accessible to pulling, pressing, lifting or squatting engagement by a user;

a traveler having a selected resistance force, the traveler being movably mounted on the rail at a stationary start position, the traveler being adapted to engage the cable under a pulling, pressing, lifting or squatting force exerted by the user on the handle, the traveler being pulled in a forward direction along the rail starting from the stationary stop position against the selected resistance force under the pulling, pressing, lifting or squatting force exerted by the user through the cable;

a stop mechanism adjustably positionable on the rail at one or more selectable stop positions each stop position spaced a predetermined distance along the rail away from the stationary start position of the traveler, the stop mechanism being adapted to prevent the traveler from travelling forwardly past a stop position selected by the user;

wherein the cable is selectively interconnectable first to a first one of the resistance members and is further selectively interconnectable to one or more additional ones of the one or more resistance members;

the selected resistance force of the traveler being less than the resistance force of the first one of the resistance members such that the pulling, pressing, lifting or squatting force exerted by the user on the handle acts first to pull the traveler along the rail to the selected position of the stop mechanism and secondly to move one or more of the multiplicity of resistance members after the traveler has been pulled along the rail to the selected position of the stop mechanism.

2. The apparatus of claim 1, wherein the cable first pulls the traveler through the selected distance along the rail on pulling, pressing, lifting or squatting of the handle by the user, the cable subsequently pulling, pressing, lifting or squatting the one or more selected resistance members on engagement of the traveler with the stop mechanism under further pulling, pressing, lifting or squatting force exerted by the user on the handle.

3. The apparatus of claim 1, further comprising:

a selected length of the cable, a selected stationary start position of the traveler, a selected interconnection of the cable to the resistance mechanism and the handle, wherein the selected length of the cable, the selected stationary start position of the traveler, and the selected interconnection of the cable to the resistance mechanism and the handle are arranged and selected such that the handle is held in a stable position in close adjacency to the handle pulley when the user is not pulling, pressing, lifting or squatting on the handle.

4. The apparatus of claim 1, wherein the rail has a selected outside contour and the traveler comprises a hollow tube having a complementary interior contour, the hollow tube slidably receiving the outside surface of the rail such that the traveler is slidably movable along the rail.

5. The apparatus of claim 4, wherein the outside contour of the rail and the inner contour of the hollow tube are selected to prevent the traveler from rotating around the rail.

6. The apparatus of claim 1, wherein the traveler includes a pulley receiving the cable, the cable first pulling the traveler to move forwardly along the rail to the selected position of the stop mechanism under the pulling, pressing, lifting or squatting force exerted by the user and secondly pulling, pressing, lifting or squatting and moving one or more of the multiplicity of selected interconnected resistance members when the traveler is prevented from travelling forwardly along the rail by the stop mechanism.

7. The apparatus of claim 1, wherein the length of the cable is selected such that the handle is held in a stable position in close adjacency to the handle pulley when the user is not pulling, pressing, lifting or squatting on the handle, the handle being selectively positionable at a start of exercise position in space that is spaced a distance away from the handle pulley that is substantially equal to the predetermined distance between the selected stop position and the start position of the traveler.

8. The apparatus of claim 1, wherein the traveler and the resistance members are interconnected to the cable such that a pulling, pressing, lifting or squatting force exerted on the handle that is greater than or equal to the resistance force of the traveler acts first to move the traveler along the rail to the selected stop position and secondly to move one or more of the resistance members when the user exerts a pulling, pressing, lifting or squatting force that is greater than the sum of the resistance force of the traveler and the selected amount of the resistance force of the one or more resistance members.

9. The apparatus of claim 1, wherein the traveler has a first selected weight, the traveler being slidably mounted and arranged on the rail such that a pulling, pressing, lifting or squatting force exerted on the handle that is greater than or equal to the first selected weight acts to move the traveler upwardly in opposition to gravity along the rail to the selected stop position.

10. The apparatus of claim 1, wherein the one or more resistance members each have an incremental weight, the resistance members each being mounted and arranged on the frame such that a pulling, pressing, lifting or squatting force exerted on the handle that is greater than the sum of the first selected weight and the incremental weight of the one or more selected resistance members pulls the one or more selected resistance members upward in opposition to gravity.

11. The apparatus of claim 1, further comprising:

a second handle mounted to the frame and interconnected to the resistance mechanism via a cable wound around a second handle pulley that is mounted to the frame at a selected position accessible to pulling, pressing, lifting or squatting engagement by the user.

12. The apparatus of claim 11, wherein a length of the cable, a stationary start position of the traveler, an interconnection of the cable to the resistance mechanism and the second handle are arranged and selected such that the second handle is held in a stable position in close adjacency to the second handle pulley when the user is not pulling, pressing, lifting or squatting on the second handle.

13. The apparatus of claim 1, wherein the frame is disposed on a floor or ground surface and the apparatus further comprises:

a first pad comprising a triangular prism having a pair of rectangular surfaces disposed at a first selected angle relative to each other, one of the rectangular surfaces of the first pad being disposed on or above a portion of the floor or ground surface that is adjacent the position of the frame on the floor or ground surface such that the user can stand, sit or kneel on top of or above the other rectangular surface of the pad with either one of a left or right foot and readily access the handle with a selected body part of the user, the first selected angle being at least about 3 degrees.

14. The apparatus of claim 1, further comprising:

a second pad comprising a triangular prism having a pair of rectangular surfaces disposed at a second selected angle relative to each other, one of the rectangular surfaces of the second pad being disposed on or above a portion of the floor or ground surface that is immediately adjacent the first pad such that the user can stand, sit or kneel on top of or above the other rectangular surface of the second pad with the other of the left or right foot and readily access the handle with a selected body part of the user, the second selected angle being at least about 3 degrees.

15. A method of performing a force resistance exercise on a machine comprising: a frame and a handle mounted to the frame and interconnected to the resistance mechanism via a cable wound around a handle pulley that is mounted to the frame at a selected position accessible to pulling, pressing, lifting or squatting engagement by a user;

a traveler having a selected resistance force, the traveler being movably mounted on a rail at a stationary start position, the traveler being adapted to engage the cable under a pulling, pressing, lifting or squatting force exerted by the user on the handle, a stop mechanism adjustably positionable on the rail at one or more selectable stop positions each stop position spaced a predetermined distance along the rail away from the stationary start position of the traveler, the stop mechanism being adapted to prevent the traveler from travelling forwardly past a stop position selected by the user;

wherein the cable is selectively interconnectable first to a first one of the resistance members and is further selectively interconnectable to one or more additional ones of the one or more resistance members;

the selected resistance force of the traveler being less than the resistance force of the first one of the resistance members such that the pulling, pressing, lifting or squatting force exerted by the user on the handle acts first to pull the traveler along the rail to the selected position of the stop mechanism and secondly to move one or more of the multiplicity of resistance members after the traveler has been pulled along the rail to the selected position of the stop mechanism;

the method comprising:

selecting a stop position for the stop member along the rail;

selecting one or more of the resistance members and interconnecting the selected one or more resistance members to the cable;

exerting a pulling, pressing, lifting or squatting force on the handle that is greater than the selected resistance force of the traveler to pull the traveler along the rail to the stop position;

exerting a pulling, pressing, lifting or squatting force on the handle that is greater than the sum of the selected resistance force of the traveler and the resistance force of the one or more selected resistance members.

16. An exercise apparatus, comprising:

a frame;

a weight stack mounted on the frame;

a cable configured to engage the weight stack through a plurality of pulleys, the cable including two terminal ends, each terminal end having a handle;

a selector movably mounted on a rail, the selector including a stop mechanism configured to prevent a slider from moving beyond a position along the rail; and a slider mounted below the selector on the rail, the slider being adapted to move freely along the rail responsive to the tension in the cable, the slider being configured to engage the stop mechanism and provide at least one of slack and tension in the cable based on a position of the selector and the stop mechanism on the rail, wherein before the slider engages the stop mechanism, the cable does not engage the weight stack, and after the slider engages the stop mechanism, the cable engages the weight stack.

* * * * *